US006294508B1

(12) United States Patent
Milbrath et al.

(10) Patent No.: US 6,294,508 B1
(45) Date of Patent: Sep. 25, 2001

(54) COMPOSITION COMPRISING LUBRICIOUS ADDITIVE FOR CUTTING OR ABRASIVE WORKING AND A METHOD THEREFOR

(75) Inventors: Dean S. Milbrath, West Lakeland Township; Mark W. Grenfell, Woodbury, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/561,658

(22) Filed: May 2, 2000

Related U.S. Application Data

(63) Continuation-in-part of application No. 09/346,093, filed on Jul. 1, 1999, now abandoned, which is a continuation-in-part of application No. 08/715,207, filed on Sep. 17, 1996, now Pat. No. 6,043,201.

(51) Int. Cl.[7] ..... C10M 131/10

(52) U.S. Cl. ..... 508/582; 508/250; 508/268; 508/307; 508/545; 72/42

(58) Field of Search ..... 508/250, 268, 508/307, 545, 582; 72/42

(56) References Cited

U.S. PATENT DOCUMENTS

| | | | |
|---|---|---|---|
| 3,129,182 | 4/1964 | McLean | 252/54 |
| 3,280,027 | 10/1966 | Pierre et al. | 252/45 |
| 3,365,397 | 1/1968 | Kolarik | 252/33.6 |
| 3,756,052 | 9/1973 | Quaal et al. | 252/49.3 |
| 3,946,083 | 3/1976 | Delaunois et al. | 508/582 |
| 4,224,173 | 9/1980 | Reick | 252/52 A |
| 4,428,851 | 1/1984 | Hisamoto et al. | 252/58 |
| 4,430,234 | 2/1984 | Hasegawa et al. | 252/49.5 |
| 4,492,641 | 1/1985 | Buchwald et al. | 252/48.4 |
| 4,497,720 | 2/1985 | Moriga et al. | 508/582 |
| 4,559,153 | 12/1985 | Baldwin et al. | 252/48.6 |
| 4,639,323 | 1/1987 | Liao | 252/32.5 |
| 4,659,488 | 4/1987 | Vinci | 252/333 |
| 4,736,045 | 4/1988 | Drakesmith et al. | 549/380 |
| 4,885,414 | 12/1989 | Schweighardt | 570/130 |
| 4,983,229 | 1/1991 | Tull | 148/246 |
| 5,032,306 | 7/1991 | Cripps | 252/68 |
| 5,091,104 | 2/1992 | VanDerPuy | 252/171 |
| 5,146,014 | 9/1992 | Graybill et al. | 570/131 |
| 5,154,845 | 10/1992 | Williams | 508/582 |
| 5,198,139 | 3/1993 | Bierschenk et al. | 252/68 |
| 5,211,861 | 5/1993 | Lafratta et al. | 252/33.6 |
| 5,393,442 | 2/1995 | Buchwald et al. | 252/54 |
| 5,476,974 | 12/1995 | Moore et al. | 568/677 |
| 5,547,593 | 8/1996 | Sanechika et al. | 508/207 |
| 5,605,882 | 2/1997 | Klug et al. | 510/411 |
| 5,676,005 | 10/1997 | Balliett | 72/42 |

FOREIGN PATENT DOCUMENTS

| | | | |
|---|---|---|---|
| 2117693 A | 10/1972 | (DE) . | |
| 0 412 788 | 2/1991 | (EP) | C10M/173/02 |
| 0 553 437 | 8/1993 | (EP) | B23K/35/40 |
| 0 565 118 | 10/1993 | (EP) | C10M/107/38 |
| 1 403 628 | 8/1975 | (GB) | C10M/3/24 |
| 49123184 A | 11/1974 | (JP) . | |
| WO 93/24586 | 12/1993 | (WO) | C09K/5/04 |
| WO 96/22356 | 7/1996 | (WO) | C11D/7/50 |
| WO 97/35673 | 10/1997 | (WO) | B21B/45/02 |

OTHER PUBLICATIONS

Jean C. Childers, The Chemistry of Metalworking Fluids, Metal–Working Lubricants, pp. 165–189 (Jerry P. Byers ed., 1994).

Pamela S. Zurer, Looming Ban on Production of CFCs, Halons Spurs Switch to Substitutes, Chem. & Eng'G News, Nov. 15, 1993, pp. 12–18.

Fluorinert™ Electronic Fluids, product bulletin 98–0211–6086(212) NPI, issued 2/91, available from 3M Co., St. Paul, Minn.

Betzalel Avitzur, Metal Forming, Encyclopedia of Physical Science and Technology, vol. 9, pp. 652–682 (Academic Press, Inc. 1992).

Leigh Mummery, Surface Texture Analysis the Handbook, Chpt. 3, pp. 26–31 and 46–51 (Hommelwerke GmbH 1990).

E. Paul DeGarmo et al., The Fundamentals of Metal Forming, Materials and Processes in Manufacturing, 7the ed., pp. 394–408 (Macmillan Publishing Co. 1988).

*Primary Examiner*—Jacqueline V. Howard
(74) *Attorney, Agent, or Firm*—Lisa M. Fagan

(57) ABSTRACT

In one aspect, this invention provides a fluid comprising one or more hydrofluoroether(s) and one or more lubricious additive(s) for the cutting and abrasive treatment of metal, cermet, or composite materials. In another aspect, the present invention provides a method of cutting and abrasively treating metal, cermet, or composite materials comprising applying to the metal, cermet, or composite workpiece and tool a fluid comprising a hydrofluoroether and a lubricious additive.

21 Claims, No Drawings

COMPOSITION COMPRISING LUBRICIOUS ADDITIVE FOR CUTTING OR ABRASIVE WORKING AND A METHOD THEREFOR

CROSS-REFERENCE

This application is a continuation-in-part of U.S. application Ser. No. 09/346,093, filed Jul. 1, 1999 now abandoned; which was a continuation-in-part of U.S. application Ser. No. 08/715,207, filed Sep. 17, 1996, now U.S. Pat. No. 6,043,201.

FIELD OF THE INVENTION

This invention relates to cutting or abrasive working operations, particularly to metal, cermet, or composite cutting or abrasive working operations, and more particularly it relates to cooling and lubricating fluids comprising one or more hydrofluoroether(s) and one or more lubricious additive(s) used in conjunction with such operations.

BACKGROUND OF THE INVENTION

Drilling and machining fluids long have been used in the cutting and abrasive working of metals, cermets, and composites. In such operations, including cutting, milling, drilling, and grinding, the purpose of the fluid is to lubricate, cool, and to remove fines, chips and other particulate waste from the working environment. In addition to cooling and lubricating, these fluids also can serve to prevent welding between a workpiece and tool and can prevent excessively rapid tool wear. See, for example, Jean C. Childers, The Chemistry of Metalworking Fluids, in METAL-WORKING LUBRICANTS (Jerry P. Byers ed., 1994).

A fluid ideally suited as a coolant or lubricant for cutting and abrasive working of metal, cermet, and composite materials must have a high degree of lubricity. It must also, however, possess the added advantage of being an efficient cooling medium that is non-persistent in the environment, is non-corrosive (i.e., is chemically inert), and preferably does not leave a substantial residue on either the workpiece or the tool upon which it is used.

Today's state of the art working fluids fall generally into two basic categories. A first class comprises oils and other organic chemicals that are derived principally from petroleum, animal, or plant substances. Such oils commonly are used either straight (i.e., without dilution with water) or are compounded with various polar or chemically active additives (e.g., sulfurized, chlorinated, or phosphated additives). They also are commonly emulsified to form oil-in-water emulsions. Widely used oils and oil-based substances include the following general classes of compounds: saturated and unsaturated aliphatic hydrocarbons such as n-decane, dodecane, turpentine oil, and pine oil; naphthalenic hydrocarbons; and aromatic hydrocarbons such as cymene. While these oils are widely available and are relatively inexpensive, their utility is significantly limited; because they are most often nonvolatile under the working conditions of a drilling or machining operation, they leave residues on tools and work pieces, requiring additional processing at significant cost for residue removal.

A second class of working fluids for the cutting and abrasive working of metals, cermets, or composites includes fluorinated hydrocarbons, such as: chlorofluorocarbons (CFCs), hydrochlorofluorocarbons (HCFCs), and perfluorocarbons (PFCs). Of these three groups of fluids, CFCs are the most useful and are historically the most widely employed. See, e.g., U.S. Pat. No. 3,129,182 (McLean).

Typically used CFCs and HCFCs include trichloromonofluoromethane, 1,1,2-trichloro-1,2,2-trifluoroethane, 1,1,2,2-tetrachlorodifluoroethane, tetrachloromonofluoroethane, and trichlorodifluoroethane. The most useful fluids of this second general class of working fluids (CFCs & HCFCs) possess more of the characteristics sought in a cooling fluid, and while they were initially believed to be environmentally benign, they are now known to be damaging to the environment. CFCs and HCFCs are linked to ozone depletion (see, e.g., P. S. Zurer, Looming Ban on Production of CFCs, Halons Spurs Switch to Substitutes, CHEM. & ENG'G NEWS, Nov. 15, 1993, at 12). PFCs tend to persist in the environment (i.e., they are not chemically altered or degraded under ambient environmental conditions).

SUMMARY OF THE INVENTION

Briefly, in one aspect, this invention provides a cooling and lubricating fluid for the cutting and abrasive treatment of metal, cermet, and composite materials wherein the fluid comprises a hydrofluoroether (HFE) and a lubricious additive. The fluid may comprise one or more HFEs and one or more lubricious additives. In another aspect, the present invention provides a method of cutting and abrasively treating metal, cermet, and composite materials comprising applying to the metal, cermet, or composite workpiece and tool a fluid comprising a hydrofluoroether and a lubricious additive.

The fluids used in the cutting and abrasive treatment of metals, cermets, and composites in accordance with this invention provide efficient cooling and lubricating media that fit many of the ideal characteristics sought in a working fluid: efficient lubrication and heat transfer volatility, non-persistency in the environment, and non-corrosivity. The fluids also do not leave a substantial residue (preferably no residue) on either the workpiece or the tool upon which they are used, thereby eliminating otherwise necessary processing to clean the tool and/or workpiece for a substantial cost savings. Because these fluids reduce tool temperature during operation, their use in many cases will also enhance tool life. The addition of lubricious additive increases tool/workpiece lubrication which minimizes the production of heat from friction, further extending tool life and producing better surface finishes on the workpiece.

DETAILED DESCRIPTION OF PREFERRED EMBODIMENTS

The fluids (i.e., liquids) of the present invention may be utilized as cooling and lubricating working fluids in any process involving the cutting or abrasive treatment of any metal, cermet, or composite material (i.e., the workpiece) suitable to such operations. These processes are characterized by the removal of material from the workpiece whose bulk temperature is less than about 80° C., preferably less than about 60° C., during the removal process. Bulk temperature is defined as the average integrated temperature of the workpiece. The most common, representative, processes involving the cutting, separation, or abrasive machining of workpieces include drilling, cutting, punching, milling, turning, boring, planing, broaching, reaming, sawing, polishing, grinding, tapping, trepanning and the like.

Metals commonly subjected to cutting and abrasive working include: refractory metals such as tantalum, niobium, molybdenum, vanadium, tungsten, hafnium, rhenium, and titanium; precious metals such as silver, gold, and platinum; high temperature metals such as nickel, titanium alloys, and nickel chromes; and other metals including magnesium, copper, aluminum, steel (including stainless steels), and other alloys such as brass, and bronze. The use of the fluids of the present invention in such operations acts to cool the machining environment (i.e., the surface interface between a workpiece and a machining tool) by removing heat and particulate matter therefrom. These fluids will also lubricate machining surfaces, resulting in a smooth and substantially residue-free machined workpiece surface.

Cermets are defined as a semisynthetic-product consisting of a mixture of ceramic and metallic components having physical properties not found solely in either one alone. Examples include, but are not limited to, metal carbides, oxides, and suicides. See Hawley's Condensed Chemical Dictionary, 12$^{th}$ Edition, Van Nostrand Reinhold Company, 1993.

Composites are described herein as laminates of high temperature fibers in a polymer matrix, for example, glass fiber in an epoxy resin. Neat hydrofluoroethers may be used as a coolant and lubricant for composites. However, lubricious additives may provide for increased drill speed for composites.

The cooling and lubricating fluids of this invention comprise hydrofluoroethers that may be represented generally by the formula:

$$(R_1—O)_n—R_2 \quad (I)$$

where, in reference to Formula I, n is a number from 1 to 3 inclusive and $R_1$ and $R_2$ are the same or are different from one another and are selected from the group consisting of alkyl, aryl, and alkylaryl groups. At least one of $R_1$ and $R_2$ contains at least one fluorine atom, and at least one of $R_1$ and $R_2$ contains at least one hydrogen atom. Optionally, though not preferred, one or both of $R_1$ and $R_2$ may contain one or more catenary (i.e., "in-chain") or noncatenary heteroatoms, such as nitrogen, oxygen, or sulfur. $R_1$ and $R_2$ may also optionally contain one or more functional groups, including carbonyl, carboxyl, thio, amino, amide, ester, ether, hydroxy, and mercaptan groups, though such functional groups are not preferred. $R_1$ and $R_2$ may also be linear, branched, or cyclic, and may contain one or more unsaturated carbon-carbon bonds. $R_1$ or $R_2$ or both of them optionally may contain one or more chlorine atoms provided that where such chlorine atoms are present there are at least two hydrogen atoms on the $R_1$ or $R_2$ group on which they are present.

Preferably, the cooling and lubricating fluids of the present invention comprise hydrofluoroethers of the formula:

$$R_f—(O—R)_n \quad (II)$$

where, in reference to Formula II above, $R_f$, R, and n are as defined for $R_1$ and $R_2$ of Formula I, except that $R_f$ contains at least one fluorine atom, and R contains no fluorine atoms. More preferably, R is a noncyclic branched or straight chain alkyl group, such as methyl, ethyl, n-propyl, iso-propyl, n-butyl, i-butyl, or t-butyl, and $R_f$ is a fluorinated derivative of such a group. $R_f$ preferably is free of chlorine atoms, but in some preferred embodiments, R contains one or more chlorine atoms.

In the interest of safety, preferably the hydrofluoroether is non-flammable. To ensure non-flammability, $R_1$ and $R_2$, or $R_f$ and R, are chosen so that the total number of hydrogen atoms in the hydrofluoroether is at most equal to the total number of fluorine atoms. Also, blends of one or more hydrofluoroethers are considered useful in the practice of this invention.

More preferably, the cooling and lubricating fluids of the present invention comprise hydrofluoroethers (HFEs) which are either: (1) alpha-, beta- and omega-substituted hydrofluoroalkyl HFEs; or (2) segregated HFEs, wherein ether-bonded alkyl or alkylene, etc., segments of the HFE are either perfluorinated (e.g., perfluorocarbon) or non-fluorinated (e.g., hydrocarbon), but not partially fluorinated.

Useful alpha-, beta- and omega-substituted hydrofluoroalkyl ether HFEs comprise HFEs described in U.S. Pat. No. 5,658,962 (Moore et al.), incorporated herein by reference, which are generally represented by the formula:

$$X—(R_f'—O)_yR''H \quad (III)$$

wherein:

X is either F, H, or a perfluoroalkyl group containing from 1 to 3 carbon atoms;

each $R_f'$ is independently selected from the group consisting of $—CF_2—$, $—C_2F_4—$, and $—C_3F_6—$;

R" is a divalent organic radical having from 1 to about 3 carbon atoms, and is preferably perfluorinated; and y is an integer from 1 to 7;

wherein when X is F, R" contains at least one F atom.

Representative compounds described by Formula III useful in the present invention include, but are not limited to, the following compounds:

$C_4F_9OC_2F_4H$
$HC_3F_6OC_3F_6H$
$HC_3F_6OCH_3$
$C_5F_{11}OC_2F_4H$
$C_6F_{13}OCF_2H$
$C_3F_7OCH_2F$
$HCF_2OCF_2OCF_2H$
$HCF_2OCF_2OC_2F_4OCF_2H$
$C_3F_7O[CF(CF_3)CF_2O]_pCF(CF_3)H$, wherein p=0 to 1
$HCF_2OC_2F_4OCF_2H$
$HCF_2OCF_2OCF_2OCF_2H$
$HCF_2OC_2F_4OC_2F_4OCF_2H$
$HCF_2OCF_2OCF_2H$
$HCF_2OCF_2OC_2F_4OCF_2H$ Preferred alpha-, beta- and omega-substituted hydrofluoroalkyl ether HFEs include $C_4F_9OC_2F_4H$, $C_6F_{13}OCF_2H$, $HC_3F_6OC_3F_6H$, $C_3F_7OCH_2F$, $HCF_2OCF_2OCF_2H$, $HCF_2OCF_2CF_2OCF_2H$, $HC_3F_6OCH_3$, $HCF_2OCF_2OC_2F_4OCF_2H$, $HCF_2OCF_2OCF_2H$, $HCF_2OCF_2OC_2F_4OCF_2H$, and mixtures thereof, some of which are available from Ausimont Corp., Milano, Italy, as GALDEN H™ fluids.

Especially preferred HFEs are segregated HFEs which comprise at least one mono-, di-, or trialkoxy-substituted perfluoroalkane, perfluorocycloalkane, perfluorocycloalkyl-containing perfluoroalkane, or perfluorocycloalkylene-containing perfluoroalkane compound. These HFEs are described, for example, in PCT Publication No. WO 96/22356, and can be represented by the formula:

$$R_f''—(O—R_h)_x \quad (IV)$$

wherein:

x is from 1 to about 3, and $R_f''$ is a perfluorinated hydrocarbon group having a valency x, which can be straight, branched, or cyclic, etc., and preferably contains from 3 to about 12 carbon atoms, and more preferably contains from 4 to about 10 carbon atoms;

each $R_h$ is independently a linear or branched alkyl group having from 1 to about 3 carbon atoms and may optionally contain one or more chlorine atoms; and either or both of the groups $R_f''$ and $R_h$ can optionally contain one or more catenary heteroatoms.

Preferably, x is 1. Most preferable $R_f'$ groups include $C_mF_{2m+1}$- isomers wherein m is from 3 to about 10 (i.e., n-, iso-, sec-, tert-) and may contain acyclic and/or cyclic portions; and most preferable $R_h$ groups include methyl, ethyl, n-propyl, and iso-propyl.

Representative compounds described by Formula IV useful in the present invention include, but are not limited to, the following compounds:

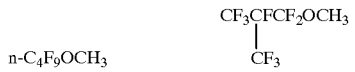

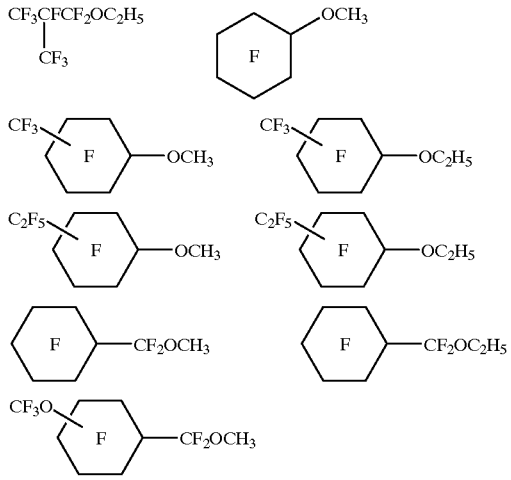

$n\text{-}C_4F_9OC_2H_5$
$C_5F_{11}OC_2H_5$
$CF_3OC_2F_4OC_2H_5$

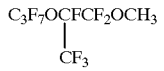

$(CF_3)_3C—OCH_3$
$(CF_3)_3C—OC_2H_5$
$C_4F_9OCH_2Cl$
$C_4F_9OCHClCH_3$
$C_{10}F_{21}OCH_3$
$C_{10}F_{21}OC_2H_5$
$(C_2F_5)_2NCF_2CF_2OCH_3$
$(CF_3)_2N(CF_2)_3OCH_3$
$(CF_3)_2N(CF_2)_2OC_2H_5$
$(C_2F_5)_2NCF_2CF_2OCH_3$

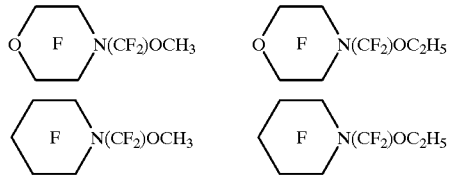

-continued

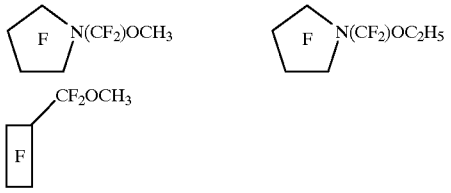

$CF_3CF(OCH_3)CF(CF_3)_2$
$CF_3CF(OC_2H_5)CF(CF_3)_2$
$C_2F_5CF(OCH_3)CF(CF_3)_2$
$C_2F_5CF(OC_2H_5)CF(CF_3)_2$
$C_3F_7CF(OCH_3)CF(CF_3)_2$
$C_3F_7CF(OC_2H_5)CF(CF_3)_2$ wherein cyclic structures designated with an interior "F" are perfluorinated.

Particularly preferred segregated HFEs of Formula IV include $n\text{-}C_4F_9OCH_3$, $C_4F_9OCH_3$, $C_4F_9OCHClCH_3$, $(CF_3)_2CFCF_2OCH_3$, $n\text{-}C_4F_9OC_2H_5$, $(CF_3)_2CFCF_2OC_2H_5$, $(CF_3)_3COCH_3$, $(CF_3)_3COC_2H_5$, $C_{10}F_{21}OCH_3$, $C_{10}F_{21}OC_2H_5$, $c\text{-}C_6F_{11}CF_2OCH_3$ (c=cyclic), $c\text{-}C_6F_{11}CF_2OC_2H_5$, $CF_3\text{-}c\text{-}C_6F_{10}OCH_3$, $CF_3O\text{-}c\text{-}C_6F_{10}CF_2OCH_3$, $CF_3\text{-}c\text{-}C_6F_{10}OC_2H_5$, $C_2F_5\text{-}c\text{-}C_6F_{10}OCH_3$, $C_2F_5\text{-}c\text{-}C_6F_{10}OC_2H_5$, $C_3F_7CF(OCH_3)CF(CF_3)_2$, $CF_3CF(OCH_3)CF(CF_3)_2$, $CF_3CF(OC_2H_5)CF(CF_3)_2$, $C_3F_7CF(OC_2H_5)CF(CF_3)_2$, and mixtures thereof. Segregated HFEs are available as 3M™ NOVEC™ Specialty Fluids HFE-7100 and HFE-7200, from Minnesota Mining and Manufacturing Company. Blends of segregated HFEs are also considered useful in practice of the invention.

The cooling and lubricating fluids of the present invention comprise one or more lubricious additives. The lubricious additives in combination with one or more HFEs can act as boundary layer or extreme pressure lubricants that react with the workpiece and tool to form a protective layer on the surface. This layer is substantially a monolayer on the workpiece and/or tool surface which minimizes galling and increases tool life while improving the surface finish of the machined surface and keeping the tool and workpiece cool. This layer forms a residue which is present following machining. This residue may be removed using one or more methods known in the art. The most useful lubricious additives will be volatile (i.e., have a boiling point below about 300° C., preferably about 250° C.) though others are also considered useful.

Useful lubricious additives include, but are not limited to, for example: saturated and unsaturated aliphatic hydrocarbons such as n-decane, dodecane, turpentine oil, and pine oil; naphthalenic hydrocarbons; aromatic hydrocarbons such as cymene; thiol esters and other sulfur-containing compounds; and chlorinated hydrocarbons including oligomers of chlorotrifluoroethylene, chlorinated perfluorocarbons, and other chlorine-containing compounds. Also useful are load-resistive additives such as phosphates, fatty acid esters, and alkylene glycol ethers. These latter classes of compounds include trialkyl phosphates, dialkyl hydrogen phosphites, methyl, ethyl, and propyl esters of $C_6$ to $C_{18}$ carboxylic acids, esters of monoalkyl ether polyethylene or ethylene glycols, propylene or ethylene glycol ethers and their esters, propylene glycol and the like. Representative load-resistive additives include triethyl phosphate, dimethyl hydrogen phosphite, propylene glycol butyl ether, polyethylene glycol methyl ether acetate, and ethylene glycol monoethylether acetate.

Particularly useful lubricious additives for use with hydrofluoroethers are the $C_6$ to $C_{18}$ fatty acids and their methyl, ethyl, n-propyl and isopropyl esters. These fatty acids and esters preferably have a boiling point of less than 300° C., more preferably less than 250° C. Examples of suitable fatty acids and esters include hexanoic acid, octanoic acid, decanoic acid, ethyl caproate, ethyl caprylate, methyl laurate, isopropyl myristate and methyl stearate. Also particularly useful as lubricious additives are lactates of $C_8$ to $C_{16}$ alcohols, such as ethylhexyl lactate.

One or more partially fluorinated or perfluorinated alkylated lubricious additives may also be added to the fluids of the present invention to further optimize the lubricious properties of the composition. Such additives typically comprise one or more perfluoroalkyl groups coupled to one or more hydrocarbon groups through a functional moiety. Suitable perfluoroalkyl groups consist of straight-chain and branched, saturated and unsaturated $C_4$–$C_{12}$ groups, and useful hydrocarbon groups include straight-chain and branched, saturated and unsaturated $C_{10}$–$C_{30}$ groups. Suitable functional linking moieties can be groups comprising one or more heteroatoms such as O, N, S, P, or functional groups such as —$CO_2$—, —CO—, —$SO_2$—, —$SO_3$—, —$PO_4$—, —$PO_3$—, —$PO_2$—, —PO—, or —$SO_2N(R)$— where R is a short chain alkyl group. Representative fluorinated or perfluorinated alkylated lubricious additives are described in European Published Application EP 565118 as alpha-olefin oligomeric derivatives of hexafluoropropylene trimers incorporated by reference herein. Also useful are perfluoropolyethers such as commercially available KRYTOX™, available from E. I. du Pont de Nemours and Company, Wilmington, Del., and FOMBLIN™, available from Ausimont S.p.A.

Generally useful concentrations of lubricious additives to hydrofluoroethers are about 0.1 to about 30 percent by weight, preferably about 0.1 to about 10 percent, and most preferably about 0.1 to about 5 percent. The concentration of each lubricious additive is independent, but is limited to a total concentration not to exceed about 30 percent, preferably about 10 percent, and most preferably about 5 percent.

The fluids of the invention can, and typically will, include one or more conventional additives such as corrosion inhibitors, antioxidants, defoamers, dyes, bactericides, freezing point depressants, metal deactivators, co-solvents, and the like. The selection of these conventional additives is well known in the art and their application to any given method of cutting and abrasive working is well within the competence of an individual skilled in the art.

The selection of the fluids of the present invention will depend upon the workpiece material, the tooling material and design, the method of fluid application, the amount of fluid applied, and the processing parameters such as feed rates and tool speeds. All of these parameters are preferably optimized.

The lubricating and cooling fluids of the present invention may be applied for the cutting and abrasive working of metals, cermets, or composites using any known technique. For example, the fluids can be applied in either liquid or aerosol form, can be applied both externally, i.e. supplied to the tool from the outside, or internally, i.e. through suitable feed provided in the tool itself.

The following examples are offered to aid in the understanding of the present invention and are not to be construed as limiting the scope thereof. Unless otherwise indicated, all parts and percentages are by weight.

EXAMPLES

Examples 1 to 4 and Comparative Example C-1

In each of the following Examples and Comparative Examples various fluids were tested for their ability to provide lubrication during a cutting operations and to dissipate heat from a metal workpiece and cutting tool. The fluids were tested by drilling ½ inch (1.27 cm) diameter holes in a ¾ inch (1.9 cm) thick piece of type 304 stainless steel at a speed of 420 rpm and at a feed rate of 3 inches/minute (7.6 cm/minute)(equivalent to 55 surface feet/minute or 1676 surface cm/minute) using a ¼ inch (0.64 cm) peck program on an Excel 510 CNC machine (available from Excel Fabricating, Inc., New Hope, Minn.). The drill bit was a 2-flute high-speed steel (HSS) twist bit (available from CLE-Forge). For each example three through holes were drilled using each fluid which was applied from a plastic squeeze bottle at a flow rate of about 30–35 mL/minute.

After the drill bit exited each completed hole, the drill was stopped and the temperatures of the drill bit and the workpiece (in the hole) were determined with a type K thermocouple fitted to an Omega (Model H23) meter (available from Omega Engineering, Stamford, Conn.). A new drill bit was used for each fluid tested. The machine load for each drilling operation was noted and averaged for the three trials. The workpiece was then cleaned to remove particulates left by these lubricious additives and the surface finish of each hole was measured using a Hommel T500 profilometer (available from Hommel America, New Britain, Conn.). Passes of ½ inch (1.3 cm) made on each hole were averaged to determine $R_a$, a measure of the surface roughness, and $R_{3z}$ and $R_{max}$, measures of the peak to valley height. Average data for each of the fluids tested, along with the standard deviation, are shown in Table 1.

The fluids used in each of the Examples were as follows:

| Example | Description |
|---|---|
| C-1 | $C_4F_9OCH_3$, available as HFE ™ 7100 from Minnesota Mining and Manufacturing Company, St. Paul, MN |
| 1 | $C_4F_9OCH_3$ with 5 wt % $C_{10}H_{21}OC_9F_{17}$, prepared as described in EP 565118 |
| 2 | $C_4F_9OCH_3$ with 5 wt % KRYTOX ™ 157FSM perfluoropolyether, (available from E. I. du Pont de Nemours and Company) |
| 3 | $C_4F_9OCH_3$ with 5 wt % FOMBLIN ™ Y25 perfluoropolyether, (available from Ausimont S.p.A.) |
| 4 | $C_4F_9OCH_3$ with 5 wt % perfluoro polyepichlorohydrin, prepared as described in U.S. Pat. No. 5,198,139 (Bierschenk et al.) |

TABLE 1*

| Example | Bit Temp °C. | Hole Temp °C. | Machine Load (%) | $R_a$ (μM) | $R_{3z}$ (μM) |
|---|---|---|---|---|---|
| C-1 | 102 (8) | 42 (7) | 80 | 5.44 (0.48) | 24.30 (2.71) |
| 1 | 65 (1) | 42 (2) | 71 | 4.80 (0.30) | 21.03 (2.72) |
| 2 | 74 (4) | 41 (2) | 68 | 4.75 (0.30) | 18.57 (1.98) |
| 3 | 72 (4) | 45 (2) | 69 | 5.18 (1.19) | 22.91 (3.73) |
| 4 | 70 (11) | 41 (2) | 68 | 4.80 (0.81) | 23.01 (3.73) |

*Values in () are the standard deviations of triplicate drilling trials.

Addition of lubricious additives to the hydrofluoroether $C_4F_9OCH_3$ reduced bit temperatures (Examples 1 to 4) and improved surface roughness (Examples 1 to 4) significantly when compared to the neat fluid (Comparative Example C-1), indicating that hydrofluoroether coolant lubricant performance can be improved by adding small amounts of other lubricious materials.

Example 5 to 6 and Comparative Examples C-2 to C-6

Examples 5 to 6 show the use of various fluids in drilling an aluminum workpiece. Comparative Examples C-3 to C-6 allow comparison with known coolant lubricant fluid formulations. Using a Hurtco CNC machine (available from Hurto Manufacturing, Indianapolis, Ind.), three through holes were drilled in a 1 inch (2.5 cm) thick block of aluminum 2024-T3, at 1000 rpm (130 surface feet/minute, about 3960 surface cm/minute) and at 8 inches (20 cm) per minute with a ½ inch (1.3 cm) high speed stainless 2 flute bit for each fluid. The test fluids were delivered from a squeeze bottle to the drill bit and hole at a flow rate of about 35–40 mL/minute. After the drilling was complete, the block was cut through the drilled holes so that they could be examined in cross section. Each cross sectioned hole half was measured and the results were averaged and recorded in Table 2. In Table 2, FC-71™ and FC-40™ are perfluorinated fluids (available from Minnesota Mining and Manufacturing Company), VERTREL™ XF is a hydrofluorocarbon of the structure $CF_3CHFCHFC_2F_5$ (available from E. I. du Pont de Nemours and Company), BOELUBE™ is a hydrocarbon lubricant (available from Orelube Corp., Plainview, N.J.), and butyl CELLOSOLVE™ is ethylene glycol monobutyl ether (available from Union Carbide Corp., So. Charleston, W. Va.). To remove the residual lubricant and particulate from the sawing process, the test pieces were cleaned prior to measuring surface roughness with a PERTHOMETER™ MP4 (available from Feinpruf Perthen GmbH, Gottingen, Germany).

TABLE 2*

| Example | Fluid | $R_a$ (μM) | $R_{3z}$ (μM) | $R_{max}$ (μM) |
|---|---|---|---|---|
| 5 | 1.5 wt % butyl CELLOSOLVE ™ in $C_4F_9OCH_3$ | 1.80 (0.33) | 7.82 (1.12) | 11.18 (2.77) |
| 6 | 10 wt % FC71 ™ in $C_4F_9OCH_3$ | 1.80 (0.46) | 8.53 1.32) | 10.74 (1.75) |
| C-2 | $C_4F_9OCH_3$ | 2.21 (0.48) | 10.10 (3.05) | 13.87 (3.78) |
| C-3 | 1.5 wt % butyl CELLOSOLVE ™ in CFC 113 | 2.77 (0.07) | 10.31 (0.58) | 10.90 (0.61) |
| C-4 | 1.5 wt % butyl CELLOSOLVE ™ in VERTREL ™ XF | 3.00 (0.15) | 11.68 (0.53) | 12.90 (1.14) |
| C-5 | FC-40 ™ | 1.75 (0.36) | 8.15 (0.99) | 11.40 (1.90) |
| C-6 | BOELUBE ™ | 1.32 (0.41) | 5.94 (1.57) | 7.14 (1.62) |

*Values in ( ) are the standard deviations of triplicate drilling trials.

The use of volatile hydrofluoroether-based coolant lubricant fluids and hydrofluoroether-based formulations containing other volatile additives (Examples 5 to 6) produced better surface finishes than other volatile CFC- and HCFC-based mixtures with the same additives (Comparative Examples C-3 and C-4). A volatile perfluorinated fluid, FC-40™, was equivalent to these hydrofluoroether-based mixtures. Comparative Example C-6, using BOELUBE™, left an oily residue on the workpiece.

Examples 7 to 11 and Comparative Example C-7

In this series of experiments, esters, an acid, and an alcohol having long hydrocarbon chains were evaluated as lubricious additives to HFE-7100 hydrofluoroether in the drilling of the aluminum workpiece. Two pieces of ½ inch (1.3 cm) thick 2024 T3 aluminum sheet were machined to a flatness specification of 0.005 inch per foot (0.035 cm/minute), and then were bolted together to form a sandwich type of test piece. The resulting test piece was then clamped to a backer plate in a Matsuura 600 VF CNC machining center. The backer plate was pre-drilled with ¾ inch (1.9 cm) holes in the same pattern as the test sequence. The drill bit used was a ⅜ inch (0.95 cm) diameter HSS twist bit (available from Konzco, Canada). Drilling was done at 6000 rpm and fed at a rate of 36 inches (91 cm) per minute. Test fluids were applied with a Bijur Fluid Flex delivery unit (available from Bijur Lubricating Corp., Bennington, Vt.) with a fluid flow adjusted to 100 mL/minute and a co-annular airflow at 20 psi (1030 torr). This unit produced a spray of fluid with a temperature drop of about 20–25° C. at a distance of 4 inches (10 cm) from the spray tip. The spray was directed at the drill bit and hole at about a 30° angle from horizontal and at a distance of about 4 inches (10 cm) from the drill bit and hole.

A series of holes were drilled in a uniformly spaced, linear row pattern where holes were 1 inch (2.5 cm) on center and nine holes in length. Two comparable rows were drilled with each test fluid. There was a 2-second pause between the drilling of each hole.

After the drilling was completed, the test plates were cleaned to remove particulate matter prior to profilometry measurements. A Hommel T500 profilometer was used with an adjustable fixture to enable measurement of the hole surface profiles. Hommel T500 Turbo software was used to calculate $R_a$, $R_{max}$, and $R_{3z}$ surface parameters for both the exit and entrance side of each hole. Values of the surface parameters were averaged and are shown in Table 3. The hole diameters were also measured with an intermicrometer, were averaged, and are shown in Table 3.

TABLE 3*

| Example | Fluid | Ra (Microinch) | Rmax (Microinch) | R3z (Microinch) | Diameter (Inch) |
|---|---|---|---|---|---|
| 7 | 2% Ethyl Octanoate in HFE-7100 | 36.6 (11.2) | 367 (142) | 181 (60) | 0.3799 (.0002) |
| 8 | 2% Octyl Acetate in HFE-7100 | 58.8 (34.4) | 569 (331) | 276 (151) | 0.3800 (.0002) |
| 9 | 2% 2-Octanol in HFE-7100 | 68.7 (34.8) | 577 (274) | 317 (147) | 0.3799 (.0002) |
| 10 | 0.5% Octanoic Acid in HFE-7100 | 44.6 (19.5) | 415 (172) | 212 (96) | 0.3799 (.0001) |
| 11 | 2% Ethylhexyl Lactate | 29.0 (12.2) | 314 (134) | 150 (60) | 0.3798 (.0001) |
| C-7 | HFB-7100 | 54.8 (18.4) | 520 (151) | 266 (89) | 0.3800 (.0007) |

*Values in ( ) are the standard deviations of 18 drilling trials.

The addition of a long hydrocarbon chain acid or its ester improved the drilling performance of HFE-7100, as can be seen by the decreased Ra in Examples 7 and 10 when compared to neat HFE-7100 (Comparative Example C-7). The use of a long chain alcohol ester of lactic acid also improved the hole quality in Example 11 when compared to neat HFE-7100 (Comparative Example C-7).

Examples 12 to 16

In this series of experiments, drilling performance was evaluated as a function of the fluid flow rate. The drilling method used in Examples 7 to 11 was used without modification here. Drilling was done at 6000 rpm and 36 inches/minute (91 cm/minute) through two plates of 2024 T3 aluminum bolted together with a ⅜ inch (0.95 cm) HSS drill bit. HFE-7100 with 2 weight percent isopropyl myristate was used as the coolant/lubricant. Fluid was delivered from a Bijur Fluid Flex unit with the air flow cut to zero (100 mL/minute) or, alternatively, with a MaxPro air driven pump (available from MaxPro Technologies, Erie, Pa.) (for 30, 16.2, 5.3 and 2.5 mL/minute). Fluid was directed at the drill bit/hole from about a 30° angle from horizontal. A total of 9 holes, 1 inch (2.5 cm) on center were drilled at each flow rate.

After the drilling was completed, the plates were separated and cleaned to remove any particulate matter prior to measuring hole surface profiles with a Hommel T500 profilometer. Surface measures, $R_a$, $R_{max}$, and $R_{3z}$, were calculated with T500 Turbo software and are presented in Table 4 as the average of those measurements.

TABLE 4*

| Example | Fluid Flowrate (mL/Minute) | Ra (Microinch) | Rmax (Micro-inch) | R3z (Micro-inch) | Diameter (Inch) |
|---|---|---|---|---|---|
| 12 | 100 | 26.8 (9.6) | 284 (71) | 143 (45) | 0.3798 (.0001) |
| 13 | 30 | 22.1 (6.6) | 231 (60) | 116 (26) | 0.3798 (.0001) |
| 14 | 16.2 | 20.4 (5.0) | 251 (93) | 109 (26) | 0.3799 (.0001) |
| 15 | 5.3 | 26.3 (10.6) | 304 (114) | 137 (48) | 0.3799 (.0001) |
| 16 | 2.5 | 36.8 (18.6) | 377 (162) | 185 (88) | 0.3800 (.0002) |
| C-7 | 100 | 54.8 (18.4) | 520 (151) | 266 (89) | 0.3800 (0.0007) |

*Values in ( ) are the standard deviations of 9 drilling trials.

With the isopropyl myristate additive, HFE-7100 performed well as a fluid, even at very low flow rates. The 5.3 mL/minute flow rate (Example 15) produced holes of nearly the same quality as those produced at 100 mL/minute (Example 12). Under all flow rate conditions the hole quality was better than that produced with neat HFE-7100 (Comparative Example C-7).

Examples 17 to 20

Drilling tests were run using essentially the same procedure as described in Examples 7 to 11, with the exception that the feed(s)/speed(s) were varied. Feed/speed parameters were chosen to maintain the chip thickness at a constant of value 0.006 inch (0.015 cm) through these variations. Fluid consisting of 2 weight percent of isopropyl myristate in HFE-7100 was delivered at 16.2 mL/minute from a MaxPro pump as a stream of fluid directed at the drill bit/hole.

After the drilling was completed, the test plates were separated and cleaned to remove any particulate matter prior to measuring surface properties $R_a$, $R_{max}$, and $R_{3z}$. These values are shown as their average in Table 5.

TABLE 5*

| Example | Speed (rpm) | Feed Rate (Inch/Minute) | Ra (Microinch) | Rmax (Microinch) | R3z (Microinch) | Diameter (Inch) |
|---|---|---|---|---|---|---|
| 17 | 750 | 4.5 | 189 (93) | 1299 (550) | 686 (208) | 0.3804 (.0007) |
| 18 | 1500 | 9 | 34.1 (8.1) | 306 (110) | 166 (42) | 0.3797 (.0001) |
| 19 | 3000 | 18 | 32.0 (9.6) | 297 (110) | 188 (168) | 0.3799 (.0001) |
| 20 | 8000 | 48 | 28.4 (6.7) | 239 (72) | 138 (32) | 0.3802 (.0003) |

*Values in ( ) are the standard deviations of 18 drilling trials.

Drilling performance improved as the speed and feed parameters increased, with the best values of surface roughness observed at 8000 rpm, 48 inches (122 cm) per minute. Better performance at higher speeds may represent productivity advantages. Also this performance was obtained with a fluid only flow rate of 16.2 mL/minute, which is a distinct advantage for economic utilization and producing a clean and dry workpiece after machining.

Example 21 and Comparative Example C-8

Drilling tests were run using essentially the same procedure as described in Examples 8 to 12, with the exception that the tooling was changed from HSS to solid carbide. The drill bits were ⅜ inch (0.95 cm) solid carbide (ULTRATOOL™ 510, available from International Incorporated, Huntington Beach, Calif.). They were used at 6000 rpm, 36 inches/minute (91 cm/minute) with a Bijur Fluid Flex fluid delivery system (100 mL/minute with 20 psi (1030 torr) air) to direct fluid at the drill bit/hole at a 30° angle from horizontal. A total of nine holes were drilled with each fluid.

The test plates were separated and cleaned to remove any particulate matter prior to measuring surface roughness with a Hommel T500 profilometer. The data from this series of tests are shown in their average in Table 6.

TABLE 6*

| Example | Tooling | Fluid | Ra (Microinch) | Rmax (Microinch) | R3z (Microinch) | Diameter (Inch) |
|---|---|---|---|---|---|---|
| 21 | Solid Carbide | 2% Ethyl Octanoate in HFE-7100 | 76.6 (34.5) | 596 (249) | 347 (150) | .3508 (.0003) |
| C-8 | Solid Carbide | HFE-7100 | 111 (43) | 847 (283) | 474 (167) | 0.3509 (.0003) |
| 7 | HSS | 2% Ethyl Octanoate in HFE-7100 | 36.6 (11.2) | 367 (142) | 181 (60) | 0.3799 (0.0002) |
| C-7 | HSS | HFE-7100 | 54.8 (18.4) | 520 (151) | 266 (89) | 0.3800 (0.0007) |

*Values in ( ) are the standard deviations of 9 drilling trials.

Although drilling with a carbide bit produces rougher holes than those produced with high-speed steel (Examples 7 and Comparative Example C-7), the same beneficial effect of additives is seen here as well (Example 21 and Comparative Example C-8).

Examples 22 to 23 and Comparative Example C-9

A piece of fiberglass epoxy composite (SCOTCHPLY™ Type 1002, available from Minnesota Mining and Manufacturing Company), ½ inch (1.3 cm) thick, was drilled with a ⅜ inch (0.95 cm) carbide twist bit at 2000 rpm, 10 inches/minute (25 cm/minute) (typical conditions) using test fluids dispensed from a Bijur Fluid Flex unit at a fluid flow rate of 100 mL/minute and an air pressure of 20 psi (1030 torr). The SCOTCHPLY™ was clamped to a 1 inch (2.5 cm) thick aluminum backer plate which had been drilled with ¾ inch (1.9 cm) holes in the pattern of the drilling test. The fluid was applied at about a 30° angle from horizontal and a distance of about 4 inches (10 cm) from the drill bit/hole. A total of 18 holes were drilled with each test fluid.

The plate was cleaned to remove particulate matter before the holes were measured for surface roughness with a Hommel T500 profilometer. $R_a$, $R_{max}$, and $R_{3z}$ were calculated from the surface profile and are shown as their average in Table 7. In Table 7, PnB is propylene glycol n-butyl ether, available from Arco Chemical Co., Hinsdale, Ill.; PtB is propylene glycol t-butyl ether, available from Arco Chemical Co.; and Isopar G is a mixture of synthetic isoparaffinic hydrocarbons, available from Exxon Chemicals, Houston, Tex.

TABLE 7*

| Example | Fluid | Ra (Microinch) | Rmax (Microinch) | R3z (Microinch) |
|---|---|---|---|---|
| 22 | 1.2% PnB/0.8 % PtB in HFE-7100 | 42.2 (6.5) | 421 (78) | 220 (30) |
| 23 | 2% Isopar G in HFE-7100 | 44.9 (9.0) | 384 (90) | 230 (42) |
| C-9 | HFE-7100 | 42.8 (6.9) | 404 (74) | 220 (33) |

*Values in () are the standard deviations of 18 drilling trials.

Examples 24 to 26

Composite material (SCOTCHPLY™ Type 1002) was drilled as described in Examples 22 to 23, with the exception that the feed and speed were increased to 4000 rpm/20 inches/minute (51 cm/minute), 6000 rpm/30 inches/minute (76 cm/minute), and 8000 rpm/40 inches/minute (102 cm/minute) using 2 percent Isopar G in HFE-7100 as the coolant/lubricant fluid. A series of 9 holes was drilled at each condition. The plate was cleaned to remove particulate matter before the holes were measured for surface roughness with a Hommel T500 profilometer. $R_a$, $R_{max}$, and $R_{3z}$ were calculated from the surface profile and are shown as their average in Table 8.

TABLE 8*

| Example | Speed (rpm) | Feed Rate (Inch/Minute) | Ra (Micro-inch) | Rmax (Micro-inch) | R3z (Microinch) |
|---|---|---|---|---|---|
| 24 | 4000 | 20 | 43.8 (7.0) | 388 (64) | 229 (34) |
| 25 | 6000 | 30 | 44.9 (8.3) | 437 (114) | 235 (41) |
| 26 | 8000 | 40 | 46.5 (5.2) | 460 (113) | 241 (27) |

*Values in ( ) are the standard deviations of 9 drilling trials.

Example 27

Into a dry 600 mL Parr reactor were added 36.3 grams (0.625 mole) of anhydrous potassium fluoride and 108 grams of anhydrous diglyme (diethylene glycol dimethyl ether). The potassium fluoride was made by spray drying, was stored at 125° C., and was ground shortly before use. The contents in the reactor were cooled with dry ice, then 125 grams (0.52 mole) of n-$C_3F_7COF$ (approximately 90 weight percent purity) was added. When the reactor reached a temperature of 52° C. and pressure of 65 psig (4190 torr), 101.5 grams (0.68 mole) of $CF_2{=}CFCF_3$ (hexafluoropropylene) was added at 70° C. and at a pressure range of 18–75 psig (1690–4640 torr) over approximately a three hour period, followed by a two hour hold period at 70° C., to produce the desired perfluoroketone intermediate, $C_3F_7C(O)CF(CF_3)_2$.

The reactor and its contents were allowed to cool to room temperature, the reactor was opened, and to the reactor were added an additional 1.5 grams of potassium fluoride, along with 14.5 grams (0.016 mole) of ADOGEN™ 464 surfactant (as 50 weight percent solids in glyme) and 119.2 grams (0.77 mole) of diethyl sulfate. (ADOGEN™ 464 surfactant, available from Witco. Corp., Oleo/Surfactant Group, Greenwich, Conn., is a tri(octyl-decyl) monomethyl quaternary ammonium chloride, 90 percent active; for this experiment, the ADOGEN™ 464 was diluted with anhydrous glyme and was vacuum fractionated of alcohol solvent to a 50 weight percent concentration in glyme.) The Parr reactor was again sealed and was heated to 52° C. with maximum agitation for three days. The reactor was then pressure-charged with 60 grams of 45 weight percent aqueous potassium hydroxide and 50 grams of deionized water, was again scaled, and was heated to 85° C. for 1½ hours. The reaction was allowed to cool overnight, the reactor was vented, and its contents were transferred to a flask for distillation. 235.2 grams of product were recovered, representing a 96.9 percent yield of the desired product, $C_3F_7CF(OC_2H_5)CF(CF_3)_2$, based on the n-$C_3F_7COF$ charge. Percent purity was 88.7 percent, based on analysis by as chromatograph.

The recovered crude $C_3F_7CF(OC_2H_5)CF(CF_3)_2$ was fractionated on a 10-plate vacuum jacketed Oldershaw column, water-washed, and dried over anhydrous magnesium sulfate. A portion of the distilled and washed product was accurately weighed when placed into an NMR tube and was spiked with a known amount of 1,4-bis(trifluoromethyl)benzene (p-HFX) for use as a cross integration or internal standard. Then a 400 MHz $^1$H-NMR spectrum (#h56881.401) and a 376 MHz $^{19}$F-NMR spectra spectrum (#f56881.402) were measured at room temperature using a Varian UNITYplus 400 FT-NMR spectrometer. This method of preparation permitted the P-HFX to be used as either 1) an internal standard for measuring the absolute weight percent concentrations of specific components; or 2) as a cross integration standard to facilitate the cross correlation of the various fluorine and proton signal intensities for evaluation of the overall sample composition.

The results from the proton and fluorine NMR cross integration determination are shown below in Table A:

TABLE A

| Component Structures | $^1$H/$^{19}$F—NMR Relative Weight Percent Concentrations (single trial measurement) |
|---|---|
| $CF_3CF_2CF_2CF(OCH_2CH_3)—CF(CF_3)_2$, 3-ethoxy-perfluoro(2-methylhexane) | 99.86 percent |
| $[(CF_3)_2—CF—]_2—CF—O—CH_2CH_3$ | 0.093 percent |
| $CF_3CF_2CF_2CF(OCH_3)—CF(CF_3)_2$ | 0.044 percent |
| $CF_3OCF_2CF_2CF(OCH_2CH_3)CF(CF_3)_2$ | 0.0057 percent |
| possible acetone | 0.0005 percent |

Results from Table A indicated the washed distillate to contain 99.86 percent of n-$C_3F_7CF(OC_2H_5)CF(CF_3)_2$, the desired product.

Examples 28 to 32

In this series of experiments, drilling performance was evaluated as a function of the fluid flow rate using $C_3F_7CF(OC_2H_5)CF(CF_3)_2$ as the coolant/lubricant with and without 2 weight percent ethyl decanoate. The drilling method employed was the same as described in Examples 12 to 16. Drilling was done at 6000 rpm and 36 inches/minute (91 cm/minute) through two plates of 2024 T3 aluminum bolted together with a ⅜ inch (0.95 cm) HSS drill bit. Fluid was delivered from a MaxPro air driven pump, and the fluid was directed at the drill bit/hole from about a 30° angle from horizontal. A total of 9 holes, 1 inch (2.5 cm) on center were drilled at each flow rate.

After the drilling was completed, the plates were separated and cleaned to remove any particulate matter prior to measuring with a Hommel T500 profilometer. Surface measures, $R_a$, $R_{max}$, and $R_{3z}$, were calculated with T500 Turbo software and are presented in Table 9.

TABLE 9*

| Example | Fluid | Fluid Flow Rate, mL/min | Ra, μIn | Rmax, μIn | R3z, μIn |
|---|---|---|---|---|---|
| 28 | $C_3F_7CF(OC_2H_5)CF(CF_3)_2$, neat | 30 | 63.6 (26.0) | 633 (257) | 315 (112) |
| 29 | $C_3F_7CF(OC_2H_5)CF(CF_3)_2$ + 2% ethyl decanoate | 30 | 33.8 (12.1) | 340 (131) | 168 (57) |
| 30 | $C_3F_7CF(OC_2H_5)CF(CF_3)_2$ + 2% ethyl decanoate | 16 | 33.2 (10.6) | 331 (136) | 164 (50) |
| 31 | $C_3F_7CF(OC_2H_5)CF(CF_3)_2$ + 2% ethyl decanoate | 6.3 | 39.2 (13.3) | 429 (184) | 195 (67) |
| 32 | $C_3F_7CF(OC_2H_5)CF(CF_3)_2$ + 2% ethyl decanoate | 1.4 | 72.7 (44.2) | 710 (420) | 331 (181) |

*Values in ( ) are the standard deviation of 9 drilling trials

Results from Example 28 show that neat $C_3F_7CF(OC_2H_5)CF(CF_3)_2$ performed adequately as a coolant lubricant based on surface roughness measurements of the drilled holes. However, results from Example 29 show that, at comparable fluid flow rate (30 mL/min), surface roughness of drilled holes was significantly reduced when 2 percent ethyl decanoate was added to the $C_3F_7CF(OC_2H_5)CF(CF_3)_2$. The "2 percent ethyl decanoate in $C_3F_7CF(OC_2H_5)CF(CF_3)_2$" fluid maintained its high lubricant performance when the fluid flow rate was reduced to 6.3 mL/minute (Example 31) and showed satisfactory lubricant performance when the fluid flow rate was reduced all the way down to 1.4 mL/minute (Example 32).

Various modifications and alterations of this invention will be apparent to those skilled in the art without departing from the scope and spirit of this invention, and it should be understood that this invention is not limited to the illustrative embodiments set forth herein.

What is claimed is:

1. A fluid for cutting and abrasively treating a metal, cermet, or composite workpiece, said fluid comprising:

a) one or more hydrofluoroether(s) according to the formula:

$$(R_1—O)_n—R_2$$

wherein:

n is a number from 1 to 3 inclusive;

$R_1$ and $R_2$ are the same or are different from one another and are selected from the group consisting of alkyl, aryl, and alkylaryl groups;

at least one of $R_1$ and $R_2$ contains at least one fluorine atom; and at least one of $R_1$ and $R_2$ contains at least one hydrogen atom; and b) one or more additive(s) to impart lubricious properties to said fluid;

wherein said workpiece has a bulk temperature of less than about 80° C. and wherein said fluid leaves a residue on said workpiece.

2. The fluid according to claim 1, wherein said hydrofluoroether(s) is selected according to the formula:

$$R_f—(O—R)_n$$

wherein:

n is a number from 1 to 3 inclusive;

$R_f$ contains at least one fluorine atom and is selected from the group consisting of alkyl, aryl, and alkylaryl groups; and R contains no fluorine atoms and is selected from the group consisting of alkyl, aryl, and alkylaryl groups.

3. The fluid according to claim 1, wherein said hydrofluoroether(s) is selected according to the formula:

$$X—(R_f'—O)_yR''H$$

wherein:

X is either F, H, or a perfluoroalkyl group containing from 1 to 3 carbon atoms; each $R_f'$ is independently selected from the group consisting of —$CF_2$—, —$C_2F_4$—, and —$C_3F_6$—;

R" is a divalent organic radical having from 1 to about 3 carbon atoms; and y is an integer from 1 to 7;

wherein when X is F, R" contains at least one F atom.

4. The fluid according to claim 1, wherein said hydrofluoroether(s) is selected according to the formula:

$$R_f''—(O—R_h)_x$$

wherein:

x is from 1 to about 3;

$R_f''$ is a perfluorinated hydrocarbon group having a valency x, which can be straight, branched, or cyclic;

each $R_h$ is independently a linear or a branched alkyl group having from 1 to about 3 carbon atoms;

each $R_h$ may optionally contain one or more chlorine atoms; and either or both of the groups $R_f''$ and $R_h$ can optionally contain one or more catenary heteroatoms.

5. The fluid according to claim 1, wherein said hydrofluoroether(s) is selected from the group consisting of: n-$C_4F_9OCH_3$, $C_4F_9OCHClCH_3$, $(CF_3)_2CFCF_2OCH_3$, n-$C_4F_9OC_2H_5$, $(CF_3)_2CFCF_2OC_2H_5$, $(CF_3)_3COCH_3$, $(CF_3)_3COC_2H_5$, $C_{10}F_{21}OCH_3$, $C_{10}F_{21}OC_2H_5$, c-$C_6F_{11}CF_2OCH_3$ (c=cyclic), c-$C_6F_{11}CF_2OC_2H_5$, $CF_3$-c-$C_6F_{10}OCH_3$, $CF_3O$-c-$C_6F_{10}CF_2OCH_3$, $CF_3$-c-$C_6F_{10}OC_2H_5$, $C_2F_5$-c-$C_6F_{10}OCH_3$, $C_2F_5$-c-$C_6F_{10}OC_2H_5$, $C_3F_7CF(OCH_3)CF(CF_3)_2$, $CF_3CF(OCH_3)CF(CF_3)_2$, $CF_3CF(OC_2H_5)CF(CF_3)_2$, $C_3F_7CF(OC_2H_5)CF(CF_3)_2$, and mixtures thereof.

6. The fluid according to claim 1, wherein said lubricious additive(s) is selected from the group consisting of: $C_6$ to $C_{18}$ fatty acids or their methyl, ethyl, n-propyl, or isopropyl esters; lactates of $C_8$ to $C_{18}$ alcohols, and mixtures thereof.

7. The fluid according to claim 1, wherein said lubricious additive(s) is selected from the group consisting of: hexanoic acid, octanoic acid, decanoic acid, ethyl hexanoate, ethyl octanoate, ethyl decanoate, isopropyl myristate, methyl laurate, and mixtures thereof.

8. The fluid according to claim 1, wherein the lubricious additive is ethyl hexyl lactate.

9. The fluid according to claim 1, wherein the lubricious additive(s) total concentration ranges from about 0.1 to about 30 percent by weight.

10. The fluid according to claim 1, wherein said bulk temperature of the workpiece less than about 60° C.

11. A method of cutting or abrasively treating a metal, cermet, or composite workpiece comprising:

a) applying to said workpiece a fluid comprising:

(i) one or more hydrofluoroether(s), and (ii) one or more additive(s) to impart lubricious properties to said fluid; and b) cutting or abrasively treating said workpiece;

wherein said workpiece has a bulk temperature less than about 80° C. and wherein said fluid leaves a residue on said workpiece.

12. The method according to claim 11, wherein said hydrofluoroether(s) is selected according to the formula:

$$(R_1—O)_n—R_2$$

wherein:

n is a number from 1 to 3 inclusive;

$R_1$ and $R_2$ are the same or are different from one another and are selected from the group consisting of alkyl, aryl, and alkylaryl groups;

at least one of said $R_1$ and $R_2$ contains at least one fluorine atom; and at least one of $R_1$ and $R_2$ contains at least one hydrogen atom.

13. The method according to claim 11, wherein said hydrofluoroether(s) is selected according to the formula:

$$R_f—(O—R)_n$$

wherein:

n is a number from 1 to 3 inclusive;

$R_f$ contains at least one fluorine atom and is selected from the group consisting of alkyl, aryl, and alkylaryl groups; and R contains no fluorine atoms and is selected from the group consisting of alkyl, aryl, and alkylaryl groups.

14. The method according to claim 11, wherein said hydrofluoroether(s) is selected from the group consisting of: n-$C_4F_9OCH_3$, $C_4F_9OCHClCH_3$, $(CF_3)_2CFCF_2OCH_3$, n-$C_4F_9OC_2H_5$, $(CF_3)_2CFCF_2OC_2H_5$, $(CF_3)_3COCH_3$, $(CF_3)_3COC_2H_5$, $C_{10}F_{21}OCH_3$, $C_{10}F_{21}OC_2H_5$, c-$C_6F_{11}CF_2OCH_3$ (c=cyclic), c-$C_6F_{11}CF_2OC_2H_5$, $CF_3$-c-$C_6F_{10}OCH_3$, $CF_3O$-c-$C_6F_{10}CF_2OCH_3$, $CF_3$-c-$C_6F_{10}OC_2H_5$, $C_2F_5$-c-$C_6F_{10}OCH_3$, $C_2F_5$-c-$C_6F_{10}OC_2H_5$, $C_3F_7CF(OCH_3)CF(CF_3)_2$, $CF_3CF(OCH_3)CF(CF_3)_2$, $CF_3CF(OC_2H_5)CF(CF_3)_2$, $C_3F_7CF(OC_2H_5)CF(CF_3)_2$, and mixtures thereof.

15. The method according to claim 11, wherein said hydrofluoroether(s) is selected according to the formula:

$$X—(R_f'—O)_yR''H$$

wherein:

X is either F, H, or a perfluoroalkyl group containing from 1 to 3 carbon atoms;

each $R_f'$ is independently selected from the group consisting of —$CF_2$—, —$C_2F_4$—, and —$C_3F_6$—;

R" is a divalent organic radical having from 1 to about 3 carbon atoms; and y is an integer from 1 to 7;

wherein when X is F, R" contains at least one F atom.

16. The method according to claim 11, wherein said hydrofluoroether(s) is selected according to the formula:

$$R_f''—(O—R_h)_x$$

wherein:

x is from 1 to about 3;

$R_f''$ is a perfluorinated hydrocarbon group having a valency x, which can be straight, branched, or cyclic;

each $R_h$ is independently a linear or a branched alkyl group having from 1 to about 3 carbon atoms;

each $R_h$ may optionally contain one or more chlorine atoms; and either or both of the groups $R_f''$ and $R_h$ can optionally contain one or more catenary heteroatoms.

17. The method according to claim 11, wherein said lubricious additive(s) is selected from the group consisting of: $C_6$ to $C_{18}$ fatty acids and their methyl, ethyl, n-propyl and isopropyl esters; lactates of $C_8$ to $C_{18}$ alcohols; and mixtures thereof.

18. The method according to claim 11, wherein said lubricious additive(s) is selected from the group consisting of: hexanoic acid, octanoic acid, decanoic acid, ethyl hexanoate, ethyl octanocate, ethyl decanoate, isopropyl myristate, methyl laurate, and mixtures thereof.

19. The method according to claim 11, wherein the lubricious additive(s) is ethyl hexyl lactate.

20. The method according to claim 11, wherein the lubricious additive(s) total concentration is from about 0.1 to about 30 percent by weight.

21. The method according to claim 11, wherein said bulk temperature of the workpiece less than about 60° C.

* * * * *

UNITED STATES PATENT AND TRADEMARK OFFICE

CERTIFICATE OF CORRECTION

PATENT NO. : 6,294,508 B1 
DATED : September 25, 2001
INVENTOR(S) : Milbrath, Dean S.

It is certified that error appears in the above-identified patent and that said Letters Patent is hereby corrected as shown below:

Column 3,
Line 14, delete “suicides” and insert in place thereof -- silicides --.

Column 9,
Table 2, Example 6, Line 1, 33, delete “FC71™” and insert in place thereof -- FC-71™ --.
Table 2, Example 6, Line 2, delete “1.32)” and insert in place thereof -- (1.32) --.

Column 15,
Line 3, delete “scaled,” and insert in place thereof -- sealed, --.

Signed and Sealed this

Twenty-seventh Day of August, 2002

*Attest:*

*Attesting Officer*

JAMES E. ROGAN
*Director of the United States Patent and Trademark Office*